US008827077B1

(12) United States Patent
Cummins

(10) Patent No.: US 8,827,077 B1
(45) Date of Patent: Sep. 9, 2014

(54) CADDY DEVICE WITH IMPROVED CAPABILITIES FOR HOLDING AND TRANSPORTING BATHROOM CLEANING EQUIPMENT AND SUPPLIES

(76) Inventor: Wallace L. Cummins, Coatesville, PA (US)

( * ) Notice: Subject to any disclaimer, the term of this patent is extended or adjusted under 35 U.S.C. 154(b) by 0 days.

(21) Appl. No.: 13/134,515

(22) Filed: Jun. 9, 2011

Related U.S. Application Data

(60) Provisional application No. 61/397,592, filed on Jun. 14, 2010.

(51) Int. Cl.
*B65D 69/00* (2006.01)

(52) U.S. Cl.
USPC ..... 206/581; 206/361

(58) Field of Classification Search
USPC ..... 206/229, 576, 581, 361, 223; 220/735, 220/736, 571, 571.1, 572
See application file for complete search history.

(56) References Cited

U.S. PATENT DOCUMENTS

| | | | | | |
|---|---|---|---|---|---|
| 973,684 | A * | 10/1910 | Thompson-Meares | ..... | 220/572 |
| 1,994,525 | A * | 3/1935 | Madda | ..... | 220/527 |
| 3,893,607 | A * | 7/1975 | Jones | ..... | 206/576 |
| 4,008,933 | A * | 2/1977 | Wanek | ..... | 312/206 |
| 5,035,321 | A * | 7/1991 | Denton | ..... | 206/225 |
| D350,632 | S * | 9/1994 | Cummins | ..... | D32/53 |
| 5,546,628 | A * | 8/1996 | Silvera | ..... | 15/257.06 |
| 5,924,566 | A * | 7/1999 | Gibbs | ..... | 206/361 |
| 5,971,141 | A * | 10/1999 | Shafik | ..... | 206/225 |
| 5,984,100 | A * | 11/1999 | Ramsey et al. | ..... | 206/581 |
| 6,050,401 | A * | 4/2000 | Michaelson | ..... | 206/225 |
| 6,109,429 | A * | 8/2000 | Cunningham et al. | ..... | 206/15.2 |
| 6,193,059 | B1 * | 2/2001 | Massaro | ..... | 206/225 |
| 7,896,153 | B2 * | 3/2011 | Shafik | ..... | 206/15.3 |
| 2004/0055927 | A1 * | 3/2004 | McNutt et al. | ..... | 206/576 |
| 2007/0151895 | A1 * | 7/2007 | Patterson | ..... | 206/581 |
| 2012/0017937 | A1 * | 1/2012 | Sabade | ..... | 134/6 |

* cited by examiner

*Primary Examiner* — David Fidei
(74) *Attorney, Agent, or Firm* — John F. A. Earley, III; Frank J. Bonini, Jr.; Harding, Earley, Follmer & Frailey, P.C.

(57) ABSTRACT

A caddy device having a walled enclosure with an opening therein, an interior space and a floor, there being a plurality of holding compartments disposed about the interior of the walled enclosure, with one holding compartment preferably having a wall with apertures therein for facilitating drainage of liquid from the holding compartment into the container space, another compartment being separated from the enclosure interior space for storing items therein; and a plunger compartment provided for storing a plunger separate from the other items.

13 Claims, 4 Drawing Sheets

CADDY DEVICE WITH IMPROVED CAPABILITIES FOR HOLDING AND TRANSPORTING BATHROOM CLEANING EQUIPMENT AND SUPPLIES

CROSS REFERENCE TO RELATED APPLICATIONS

The benefit under 35 U.S.C. §119(e) of U.S. Provisional Patent Application Ser. No. 61/397,592 filed on Jun. 14, 2010 is hereby claimed, and U.S. Provisional Patent Application Ser. No. 61/397,592 is incorporated herein by reference in its entirety.

BACKGROUND OF THE INVENTION

1. Field of the Invention

The invention relates to maintenance and janitorial equipment, and more particularly, to a caddy for storing and transporting cleaning supplies.

2. Brief Description of the Related Art

Equipment for holding and transporting cleaning items is commercially available. One example of a bucket having storage receptacles is shown in my U.S. Design Pat. 350,632 which was issued on Sep. 13, 1994. Cleaning supplies, such as for example, spray bottles, towels, brushes and sponges, as well as other cleaning items suited to the type of maintenance/cleaning to be performed, may be required to be carried from room to room, such as, in office complexes, hotels, schools and other buildings.

Though caddy devices have been commercially produced, a need exists for an improved caddy device which facilitates holding and transporting items.

SUMMARY OF THE INVENTION

A caddy device is provided having storage components for storing items. According to a preferred embodiment, the caddy device has storage components provided in its interior. A handle preferably is provided to facilitate transporting the caddy device and its contents from one location to another.

The caddy device further provides specially configured components or compartments for storing items. For example, embodiments of the caddy device may be configured to be particularly suitable for bathroom type cleaning applications.

Preferably, the storage caddy is water resistant and is constructed to prevent water seepage from the caddy. A preferred construction of the caddy device is designed for use in connection with bathroom cleaning applications, and is configured to provide storage for a toilet plunger.

The caddy device may be used in connection with bathroom cleaning, and the holding components may be configured to hold and store bathroom cleaning items, so that the items may be held in a single place. The caddy device also is constructed so that the devices held may be easily moved from place to place with the caddy device. In addition, the construction of the device and placement of the holding component features facilitates capture of drips of water and/or chemical (such as cleaners) from the cleaning accessories that may be used and held by the caddy device.

According to preferred embodiments, the present device is designed with a designated holder configured to hold a plunger. The use of plungers is common, especially when bathrooms of a building, such as schools or offices, which contain a number of toilets, are cleaned. The present caddy device is configured to hold wet or dry plungers, and facilitate containing drips from the plungers. The device according to a preferred embodiment, also is configured to provide a separate holding area for the plunger so that it may be stored separate from other items, such as towels for cleaning mirrors, and other items where it would be undesirable to have potential contamination with the plunger or water drips therefrom.

These and other advantages are provided by my invention.

BRIEF DESCRIPTION OF THE DRAWING FIGURES

DETAILED DESCRIPTION OF THE PREFERRED EMBODIMENTS

Figure 1:
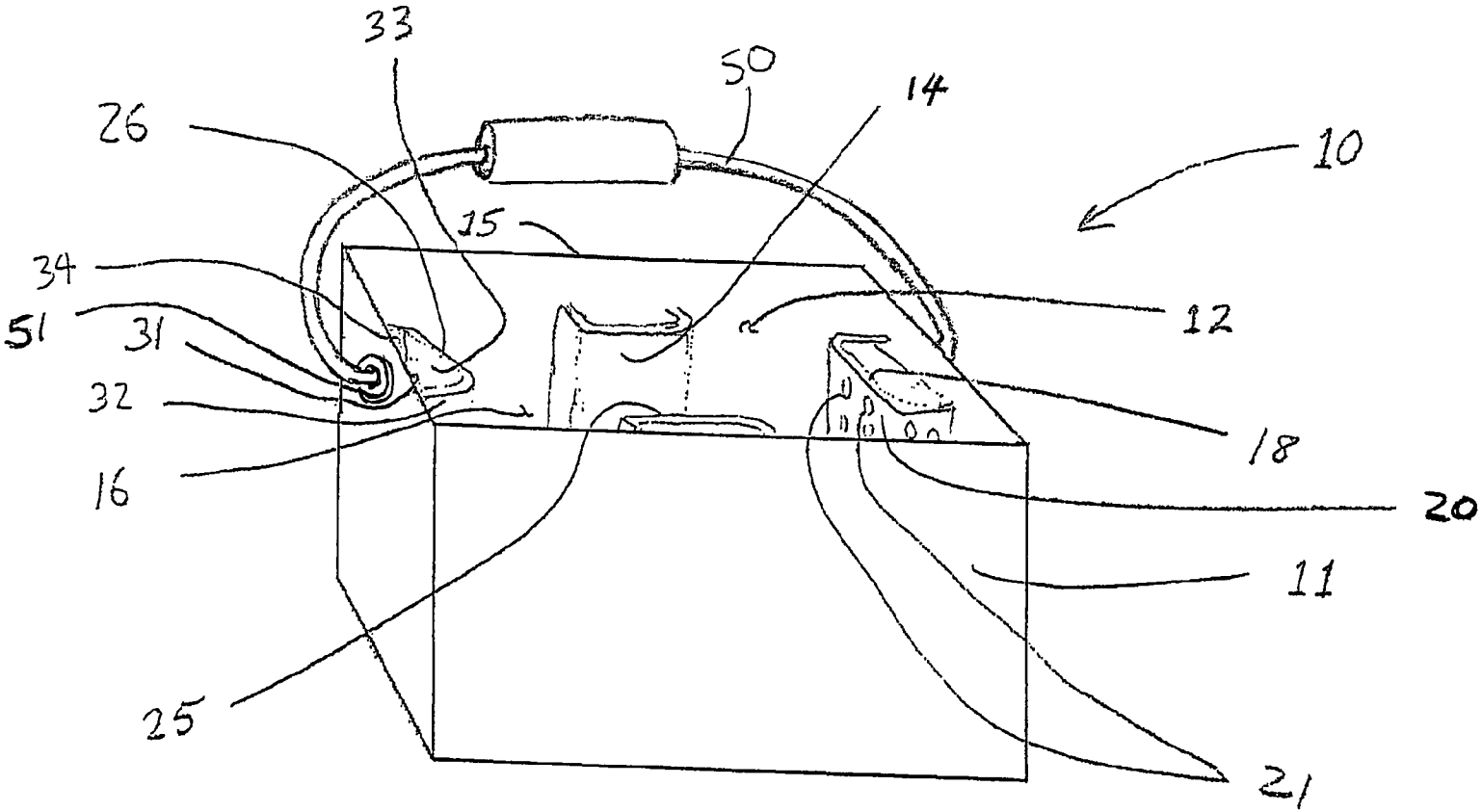
FIG. 1 is a front perspective view of a caddy device according to a first embodiment.
Figure 2:
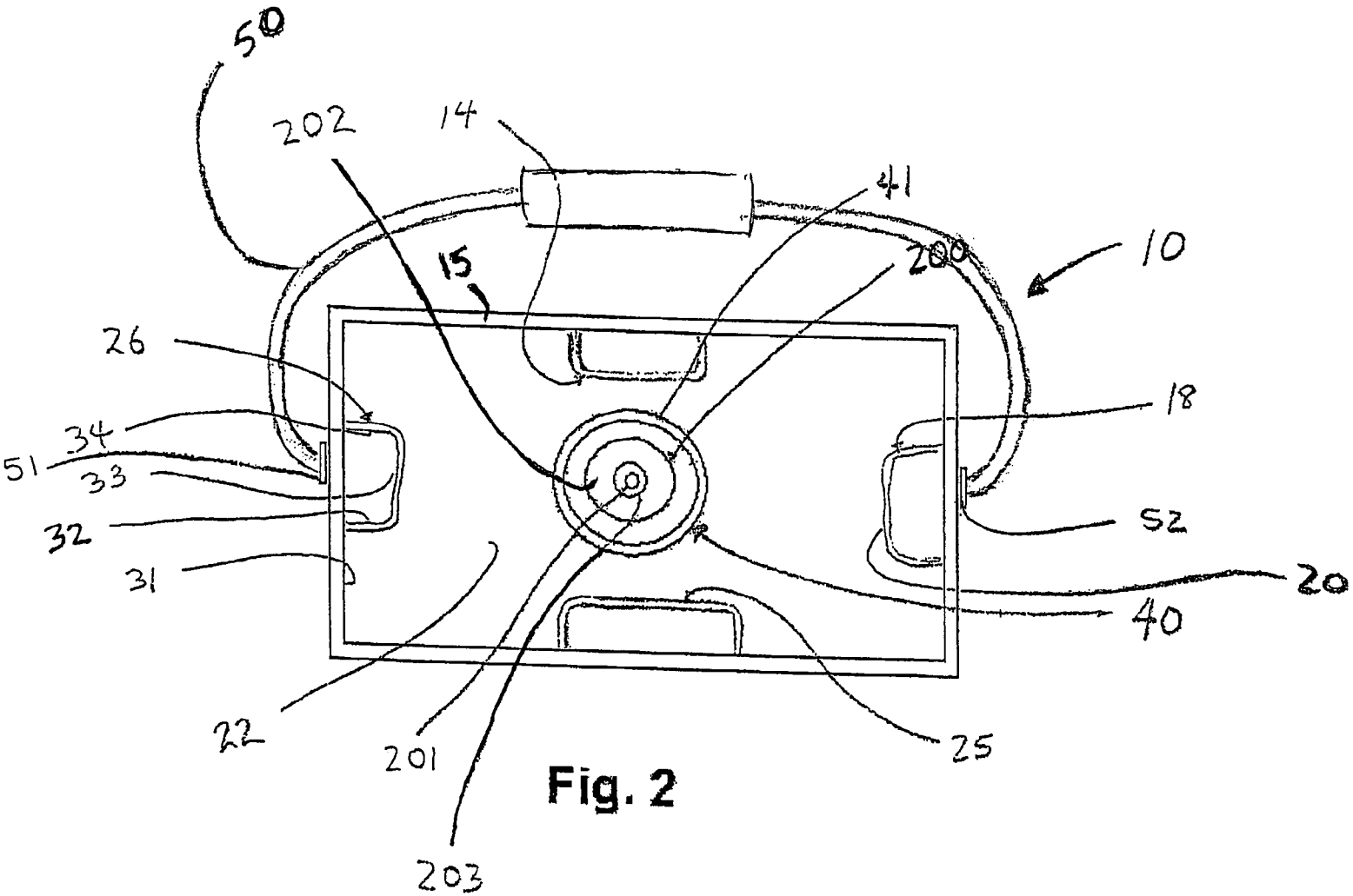
FIG. 2 is a top plan view of the device of FIG. 1.

Referring to FIGS. 1-4, there is illustrated a caddy device 10 constructed in accordance with a preferred embodiment of my invention. The caddy device 10 is configured as a walled enclosure 11 with an opening 12 at the top thereof. A plurality of holding features are provided, and preferably, are configured for carrying one or more particular bathroom cleaning aids. According to the preferred embodiment illustrated, a first holder 14 is provided and preferably is dimensioned to hold a spray bottle, such as, for example, a liquid glass cleaner bottle. Generally, the bottles have a larger sized component to them, as well as a narrower sized component. The first holding feature, the first holder 14, is provided to accommodate the dimensions of several generally commercially sold cleaner products, in particular, such as, for example, glass cleaner products. The first holder 14 preferably may be constructed so that it is spaced a distance from the upper edge 15 of the container enclosure 11 to facilitate placement of the bottle into the interior container space 16 so that alignment of the bottle may take place with the bottle over the container opening 12 so that drips or other material from the bottle, if there were to be any, may fall into the container enclosure 11.

Figure 3:
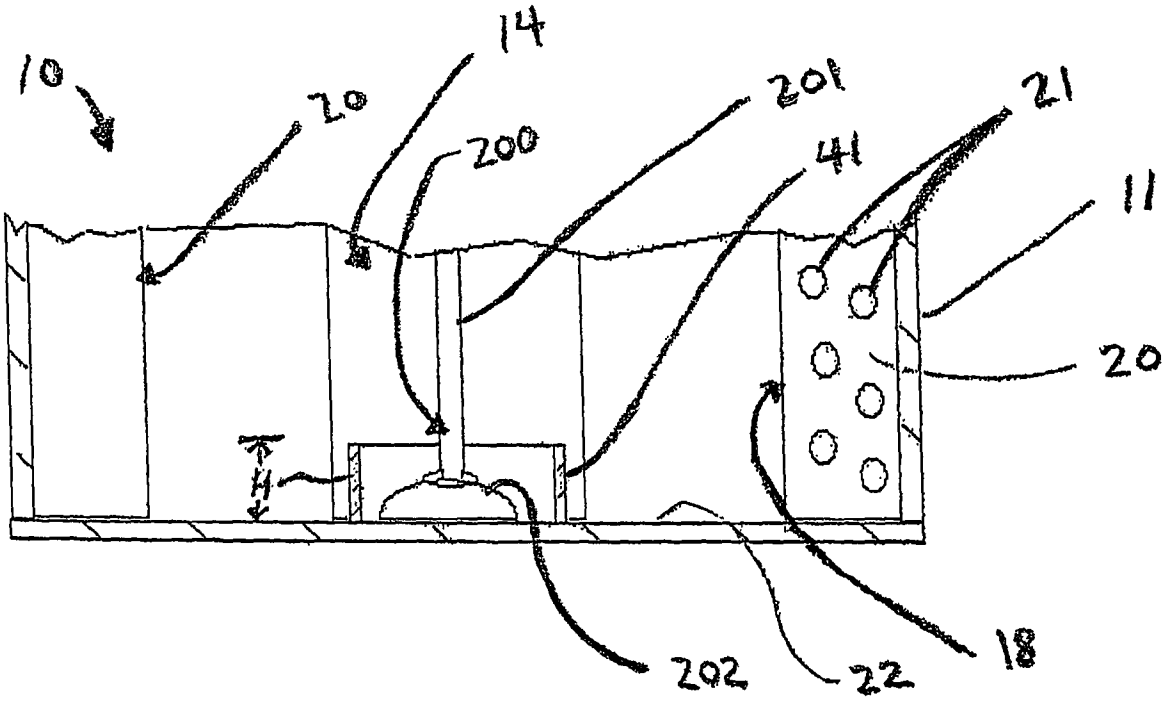
FIG. 3 is an enlarged sectional view of the caddy device of FIG. 1, showing the sidewalls in partial view.
Figure 4:
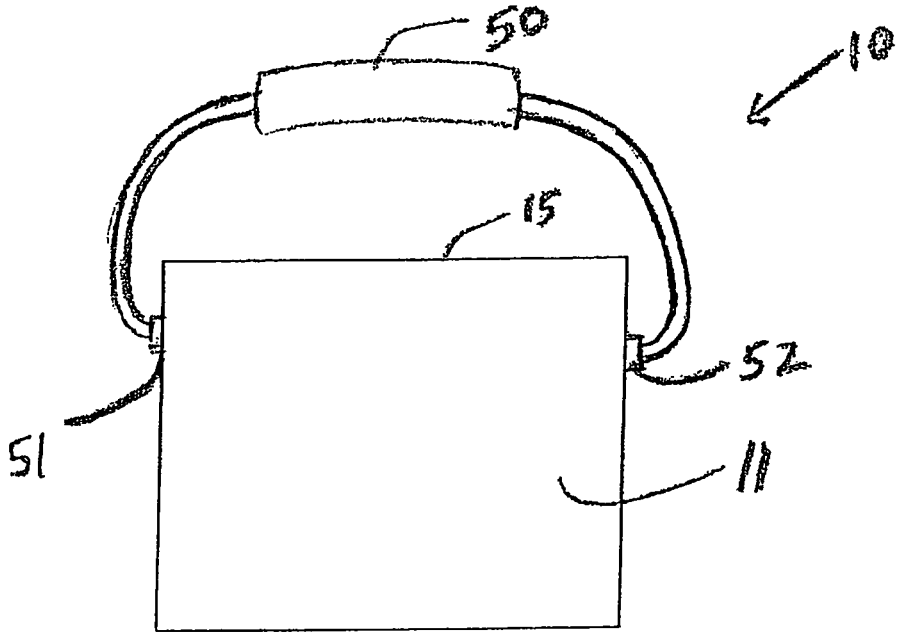
FIG. 4 is a front elevation view of the caddy device of FIG. 1.

Preferably one or more additional holders are provided, such as, for example, the second holder 18 which is shown preferably provided as a walled construction, having at least one side wall 20. A drainage mechanism is provided, and preferably includes a plurality of apertures 21 disposed in the side wall 20. Though the side wall 20 is shown in FIG. 3 leading to the container enclosure floor 22, the side wall 20 may join the container floor 22, or alternately, may be provided with a separate floor that is disposed above the container enclosure floor 22. A separately provided floor may have apertures therein (not shown) so that items may drain into the container enclosure space 16. For example, according to a preferred holding mechanism, the second holder 18 is configured to hold a toilet brush (not shown). When used, the toilet brush remains wet, generally with water and chemicals. Drips from the brush are not uncommon, and when a wet brush is transported from one location to another there is the potential for drips to discolor carpet or other floor surface, as some chemicals may adversely react with the floor coverings. The caddy device 10 is designed to facilitate holding and transporting bathroom cleaning equipment and supplies. A third holder 25 is shown configured to hold bathroom supplies, such as, for example, toilet bowl cleaner. The third holder 25 may be constructed similar to the first holder 14, and may be dimensioned to accommodate commercially available cleaner bottles or containers.

A fourth holder compartment 26 is shown provided on the interior wall 31 of the walled container enclosure 11. Items, such as towels, safety gloves (e.g., rubber gloves), and/or sponges, may be stored within the fourth holder 26. Preferably, the fourth holder 26 is provided with at least one wall, and may be provided with three walls, as illustrated, including a first side wall 32, a mid wall 33, and a second side wall 34, with the side walls 32, 34 adjoining the mid wall 33 and interior wall 31 of the container enclosure 11.

Preferably, the holders are provided along the perimeter of the enclosure 11, as illustrated in FIGS. 1-4.

The preferred configuration illustrated in FIGS. 1-4 preferably maintains the sponges, towels and other materials in one or more of the holders separate from potential contamination or contact with the toilet brush or contents thereof (e.g., drips). For example, where some cleaning materials, such as towels, are desired to be kept dry, exposure to water may render them unusable, especially paper towels. The caddy device 10 is configured so that a holder, such as the fourth holder compartment 26, is provided with a walled structure to maintain the items desired to be kept dry separate from the wet items, and potential water (and/or chemical) drips or puddles that may form in the bottom of the enclosure 11.

Preferably, the caddy device 10 includes a separate plunger compartment 40 designed to hold a toilet plunger 200 (FIG. 3). The plunger compartment 40 preferably has a circumferential wall 41 that is upstanding from the enclosure floor 22. The wall 41 has a height component "H", and is designed to hold a toilet plunger 200. The plunger 200 is shown having a shaft or handle 201 and a head or cup 202 with a collar that connects with the handle 201. The water from the plunger 200 may drip into the walled enclosure 11 where it may be contained, and more preferably, may be contained in the plunger compartment 40. According to a preferred embodiment, the plunger compartment 40 may be constructed so that contents or drippings from the compartment 40 preferably are isolated from the other compartments, and even the portion of the container enclosure floor 22 that is outside of the plunger compartment 40. According to a preferred embodiment, the plunger compartment 40 has a diameter of slightly larger than six inches to accommodate a standard type and size toilet plunger. The diameter may be provided in smaller sizes for smaller sized toilet plungers, such as, for example, four inch size plungers. For example, according to a preferred embodiment, the plunger compartment 40 is provided with a diameter of about 4½ inches. Since a typical plunger may be about 10½ inches in height, and about 4 inches in diameter, the plunger compartment having preferred dimensions facilitates holding the plunger securely within the bucket 10 during transport of the bucket 10 and its contents.

The caddy device 10 includes a handle 50 for facilitating transport of the device 10 and the supplies and equipment held therein. The handle 50 has a preferred configuration that is circular so that it may swing over the walled enclosure 11. According to preferred embodiments, the handle 50 is configured to have a swing arc and height so that a user holding the handle 50 may lift the device 10 while a plunger 200 is held by the plunger compartment 40. The preferred handle 50 is provided so that a user may grasp the handle 50 and move the device 10 without disrupting the plunger 200. The handle 50 may swing beyond the first edge 15 or opposing edge 17, to provide unobstructed access into the enclosure opening 12, so that the equipment and supplies may be readily removed from and placed into the caddy device 10. The handle 50 is shown having pivot connections 51, 52, which preferably may be formed in the handle ends or separately provided to connect the handle 50 to the walled enclosure 11. Alternately, connectors may be provided to pivotally fasten the handle 50 to the enclosure 11.

Preferably, the caddy device 10 is constructed from materials which are water resistant, and also are resistant to general bathroom cleaners, such as typical cleaners used to clean toilets, glass, bathroom hardware and fixtures. Preferably, the caddy device 10 is provided so that it may be easily transported through standard doorways of buildings and structures, and, according to preferred embodiments, preferably is sized so that it may be readily transported through doorways that are about 31 inches and wider.

Figure 5:
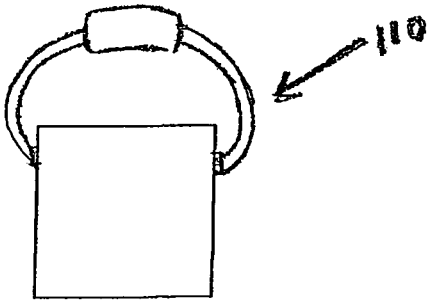
FIG. 5 is a front elevation view of an alternative embodiment of my invention showing a caddy device having a square configuration.
Figure 6:
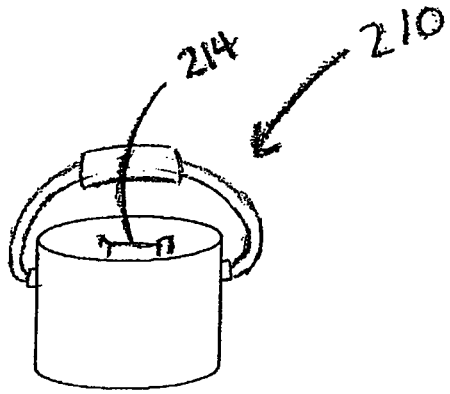
FIG. 6 is a perspective view of an alternative embodiment of my invention showing a caddy device having a round configuration.

Though FIGS. 1 through 4 illustrate a preferred embodiment of the caddy device 10 which has a rectangular configuration (that is, a caddy device having a rectangular-shaped outer periphery when viewed in top plan), according to an alternative embodiment, a caddy device, constructed in accordance with the invention, may have a round configuration (that is, the caddy device according to an alternative embodiment of the invention may have a circular outer periphery when viewed in top plan) with the compartments, including the plunger compartment being provided as described herein. FIG. 6 illustrates such an alternative embodiment showing a caddy device 210 having a round configuration. Though only one holder compartment 214 is shown in FIG. 6, the interior of the caddy device 210 may be provided with the plurality of holder compartments as shown and described herein in connection with the embodiment illustrated in FIGS. 1 through 4. FIG. 5 illustrates an alternative embodiment showing a caddy device 110 having a square configuration (that is, a caddy device having a squared-shaped outer periphery when viewed in top plan). Though not shown in FIG. 5, the interior may be provided with the holder compartments as shown and described herein in connection with the embodiment illustrated in FIGS. 1 through 4.

While the invention has been described with reference to specific embodiments, the description is illustrative and is not to be construed as limiting the scope of the invention. For example, though not shown, the plunger compartment, according to an alternative embodiment, may be constructed with a flexible cover member that may be formed from a plurality of elastomeric sections or baffles, through which the plunger cup may be inserted and removed. Various modifications and changes may occur to those skilled in the art without departing from the spirit and scope of the invention described herein and as defined by the appended claims.

What is claimed is:

1. A caddy device for holding and transporting cleaning accessories and a plunger, comprising:

a walled enclosure having an opening therein, an interior space, and a floor, the walled enclosure being formed by the floor and a circumferential wall of the walled enclosure extending upwardly from the floor;

a plurality of holding compartments disposed within said walled enclosure;

a plunger compartment for holding a plunger, the plunger compartment having a circumferential wall that extends upwardly from the floor of the walled enclosure inside and spaced apart from the circumferential wall of the walled enclosure, the plunger compartment being constructed and configured to securely hold a plunger within the plunger compartment of the caddy device during transport of the caddy device and its contents, the plunger compartment being constructed and configured to provide a separate holding area for the plunger so that the plunger may be stored separate from the cleaning accessories that may be held in the holding compartments of the caddy device, and the plunger compartment having an opening thereto through which a plunger may be inserted to place the plunger in the plunger compartment, the opening to the plunger compartment being defined by the circumferential wall of the plunger compartment a plunger adapted to be held within said plunger compartment, the plunger having a cup end and a handle end, the plunger compartment being configured to receive the cup end of a plunger therein, the plunger compartment having a diameter, the diameter of said plunger compartment being slightly larger than the cup end of the plunger to facilitate holding the cup end of the plunger within said plunger compartment when the device is transported; and a handle pivotally connected on opposite sides of the walled enclosure, wherein the handle is provided with a configuration that permits said handle to clear said walled enclosure opening to facilitate access to said enclosure space, and wherein said handle has a swing arc that is sufficiently high to provide clearance for the hand of a user holding the handle in relation to the handle end of the plunger when a plunger is held in the plunger compartment;

the caddy device being water resistant and constructed and configured to prevent water seepage from the caddy device;

wherein the floor includes a first floor portion and a second floor portion, the first floor portion being provided within the area defined by said plunger compartment upwardly extending circumferential wall, said first floor portion defining the floor of the plunger compartment, wherein said second floor portion is provided between the plunger compartment upstanding circumferential wall and the circumferential wall of the walled enclosure;

the walled enclosure being constructed and configured to capture therein drips of water and/or chemicals from cleaning accessories that may be held in the caddy device; and the caddy device being constructed and configured so that the cleaning accessories and the plunger that may be held therein may be easily moved from place to place with the caddy device with a user carrying the caddy device by the handle.

2. The caddy device of claim 1:

wherein the walled enclosure includes at least one wall having an exterior surface and an interior surface;

wherein said plurality of holding compartments are disposed about the interior of the walled enclosure and being provided on said interior wall surface.

3. The caddy device of claim 2, wherein at least one of said plurality of holding compartments has a wall with apertures therein; said apertures being provided for facilitating drainage of liquid from said at least one holding compartment into said container space.

4. The caddy device of claim 3, wherein at least one compartment includes a compartment space that is separated from said enclosure interior space.

5. The caddy device of claim 1, wherein said plurality of holding compartments includes at least three holding compartments.

6. The caddy device of claim 3, wherein said plurality of holding compartments includes at least three holding compartments.

7. The caddy device of claim 1, wherein said plunger compartment comprises a flexible material through which said plunger end may be inserted and removed.

8. The caddy device of claim 1, wherein said walled enclosure has a substantially circular periphery when viewed in top plan.

9. The caddy device of claim 1, wherein said walled enclosure has a substantially rectangular periphery when viewed in top plan.

10. The caddy device of claim 1, wherein said walled enclosure has a substantially square periphery when viewed in top plan.

11. A bathroom caddy device for holding and transporting cleaning accessories and a plunger, comprising:

a walled enclosure having at least one wall, a floor and an opening for access there into, the wall and floor being connected to define an enclosure space therein;

a handle for facilitating transporting of said caddy device;

mounting means for pivotally mounting said handle on said caddy device wall;

a first compartment provided within said enclosure space that separates at least one portion of said enclosure space from at least one other portion of said container space;

a second compartment provided within said enclosure space that separates at least one portion of said enclosure space from at least one other portion of said container space;

a third compartment provided within said enclosure space that has at least one wall defining said third compartment and a plurality of apertures disposed in said at least one wall for facilitating drainage of liquid from said third compartment into said enclosure space; and a plunger compartment disposed on the floor of said walled enclosure and being formed by an upstanding circumferential wall that extends upwardly from the floor of the walled enclosure inside and spaced apart from the wall of the walled enclosure, the plunger compartment being constructed and configured to securely hold a plunger within the plunger compartment of the caddy device during transport of the caddy device and its contents, the plunger compartment being constructed and configured to provide a separate holding area for the plunger so that the plunger may be stored separate from the cleaning accessories that may be held in the holding compartments of the caddy device, and the plunger compartment having an opening thereto through which a plunger may be inserted to place the plunger in the plunger compartment, the opening to the plunger compartment being defined by the circumferential wall of the plunger compartment;

a plunger adapted to be held within said plunger compartment, the plunger having a cup end and a handle end, the plunger compartment being configured to receive the cup end of a plunger therein, the plunger compartment having a diameter, the diameter of said plunger compartment being slightly larger than the cup end of the plunger to facilitate holding the cup end of the plunger within said plunger compartment when the device is transported; and wherein the handle is provided with a configuration that permits said handle to clear said walled enclosure opening to facilitate access to said enclosure space, and wherein said handle has a swing arc that is sufficiently high to provide clearance for the hand of a user holding the handle in relation to the handle end of the plunger when a plunger is held in the plunger compartment;

wherein the floor includes a first floor portion and a second floor portion, the first floor portion being provided within the area defined by said plunger compartment upwardly extending circumferential wall, said first floor portion defining the floor of the plunger compartment, wherein said second floor portion is provided between the plunger compartment upstanding circumferential wall and the circumferential wall of the walled enclosure;

the caddy device being water resistant and constructed and configured to prevent water seepage from the caddy device;

the walled enclosure being constructed and configured to capture therein drips of water and/or chemicals from cleaning accessories that may be held in the caddy device; and the caddy device being constructed and configured so that the cleaning accessories and the plunger that may be held therein may be easily moved from place to place with the caddy device with a user carrying the caddy device by the handle.

12. The device of claim 11, wherein said walled enclosure has an upper edge defining a perimeter of the device, and wherein said first compartment is spaced from said upper edge.

13. A kit for bathroom cleaning applications comprising:

a) the caddy of claims 1; and b) one or more cleaning supplies.

* * * * *